US005339850A

United States Patent [19]

Mertz

[11] Patent Number: 5,339,850

[45] Date of Patent: Aug. 23, 1994

[54] ORTHOPEDIC HAND GRIP FOR AMBULATION AIDS, TOOLS AND OTHER IMPLEMENTS

[75] Inventor: Steven H. Mertz, Denver, Colo.

[73] Assignee: Guardian Products, Inc., Arleta, Calif.

[21] Appl. No.: 820,537

[22] Filed: Jan. 14, 1992

Related U.S. Application Data

[63] Continuation-in-part of Ser. No. 706,098, May 28, 1991, Pat. No. Des. 339,468.

[51] Int. Cl.[5] ..... A61H 3/02

[52] U.S. Cl. ..... 135/72; 135/76

[58] Field of Search ..... 135/72, 76; 280/821, 280/822; 482/40, 45, 49, 50, 70, 75

[56] References Cited

U.S. PATENT DOCUMENTS

| | | | |
|---|---|---|---|
| D. 218,509 | 8/1970 | Levy | 135/72 X |
| D. 248,510 | 7/1978 | DiVito . | |
| 1,229,658 | 6/1917 | Sandow | 482/50 |
| 2,516,852 | 8/1950 | Burry et al. | 135/72 X |
| 3,040,757 | 6/1962 | Smith . | |
| 3,436,090 | 4/1969 | Lange et al. | 280/821 |
| 3,517,678 | 6/1970 | Gilsdorf . | |
| 3,545,784 | 12/1970 | Alsop . | |
| 3,768,495 | 10/1973 | Smith | 135/72 |
| 3,879,048 | 4/1975 | Penney | 280/821 |
| 3,995,650 | 12/1976 | DiVito . | |
| 4,061,347 | 12/1977 | Stern et al. . | |
| 4,563,118 | 1/1986 | Liljedahl . | |
| 4,572,227 | 2/1986 | Wheeler . | |
| 4,613,156 | 9/1986 | Lajos | 280/821 |
| 4,641,857 | 2/1987 | Gailiunas | 280/821 |
| 4,765,856 | 8/1988 | Doubt . | |
| 4,785,495 | 11/1988 | Dellis . | |

FOREIGN PATENT DOCUMENTS

| | | | |
|---|---|---|---|
| 688541 | 2/1940 | Fed. Rep. of Germany | 135/72 |
| 2310986 | 9/1974 | Fed. Rep. of Germany | 135/72 |
| 1101212 | 4/1902 | France | 135/72 |
| 1112170 | 3/1956 | France . | |
| 2382250 | 11/1978 | France | 280/822 |
| 2503571 | 10/1982 | France | 280/821 |

OTHER PUBLICATIONS

Liko Medical Advertisement citing U.S. Patent No. 4,563,118; Canada Patent No. 1191462 and Europe Patent No. 0053596.

*Primary Examiner*—Carl D. Friedman
*Assistant Examiner*—Lan C. Mai

[57] ABSTRACT

A hand grip for canes, crutches, walkers, outrigger skis, tools, etc., includes an elongated body possessing an axially inner end provided with a recess configured for partially receiving an elongated cylindrical support member of the ambulation aid, and an axially outer end including an enlarged circular ridge for preventing axial displacement of a user's hand. A mounting post extends axially through the body, transversely securing the hand grip to the support member. An obliquely forwardly and downwardly inclined platform on an upper side of the body adjacent the inner end applies a major portion of the user's weight to the hypothenar muscles of the user's hand. A depression formed axially outwardly of the platform provides a downwardly and axially outwardly curving concave load bearing surface for engagement with thenar muscles of a hand of a user such that the thumb of the user's hand is maintained in a palmar abducted orientation. A palmar arch supporting surface formed on a front portion of the body contiguously with the platform and depression possesses a convex curvature in both circumferential and axial directions. A plurality of axially spaced discrete finger indentations formed in a lower front portion of the body are disposed at an oblique angle with respect to a longitudinal axis of the support member. The platform, depression, palmar arch supporting surface and finger indentations prevent rotation of the hand of a user about a longitudinal axis of the body and maintain the wrist and arm of the user in axial alignment with the support member.

10 Claims, 10 Drawing Sheets

ORTHOPEDIC HAND GRIP FOR AMBULATION AIDS, TOOLS AND OTHER IMPLEMENTS

RELATED APPLICATIONS

This application is a continuation-in-part of U.S. Design patent application Ser. No. 07/706,098 filed May 28, 1991.

BACKGROUND OF THE INVENTION

The present invention relates to hand grips, and more particularly pertains to an improved hand grip for ambulation aids such as crutches, walkers, canes, outrigger skis, etc., adapted to reduce chronic fatigue, pain and damage to nerves, tendons, cartilage, bone and muscles frequently experienced by individuals who regularly use such ambulation aids. Typically, ambulation aids such as crutches employ hand grips of a substantially cylindrical shape, some of which include finger recesses similar to those found on bicycle hand grips. Such conventional grips are typically formed from a relatively hard rubber or plastic, although foam rubber covers or padding have been provided in an effort to enhance user comfort. Individuals employing ambulation aids on a daily basis fitted with such conventional grips experience potentially debilitating tissue damage for several reasons. First, conventional hand grips concentrate pressure on areas of the hand least suited for bearing such loads, such as the volar aspect of the palm and the adductor pollicis muscle located in the web of the hand between the thumb and forefinger. This undesirable load distribution results in the compression of the median, ulnar and palmar nerves, as well as the ulnar and palmar arteries. Such compression results in the restriction of blood flow and nerve entrapment syndromes, specifically, carpal tunnel syndrome. Prolonged excessive loading in the region of the adductor pollicis muscle can result in permanent injury to the proper palmar digital nerves of the thumb and the flexor pollicis longus tendon. Second, conventional grips do not properly axially align the hand and wrist with the ulna and radius bones of the arm. Rather, conventional grips promote dorsal flexation of the wrist, resulting in increased tensional stress on the tendons, nerves and blood vessels on the palmar side of the wrist, while at the same time forcing the wedge-shaped anticular disc of cartilage separating the radius and ulna bones of the arm from the lunate and scaphoid bones of the wrist too far into the interface between the arm and wrist. This compression of the disc forces the bones apart and places compressive stress on the radial, medial and ulnar nerves, blood vessels and ligaments. Misalignment of the wrist and arm is particularly exacerbated by the typical use of ambulation aids in a manner which disposes the elongated support member at an acute angle to the vertical. Individuals paralyzed from the waist down employ a technique known as "gaiting" in order to ambulate using crutches. This technique places the entire weight of the user on the hands, while the crutch shafts are disposed at an acute angle to the vertical. Such individuals are particularly susceptible to permanent debilitating injury to the hands and wrists.

An individual, upon being fitted with conventional ambulation aids such as crutches, typically experiences an initial period of great discomfort and fatigue. Due to natural strengthening of muscles, the individual then generally experiences a short term reduction of pain and fatigue. Over the long term, however, the degeneration of nerves, tendons and cartilage in the hands and wrists of the individual results in increasing fatigue, loss of strength, and pain. Many such individuals actually become unable to continue to employ crutches, and are forced into wheelchairs.

Accordingly, it is highly desirable to distribute forces in a manner such that a major portion of the force is born by muscles, rather than nerves, blood vessels and tendons. Muscles are natural load bearing cushions in compression. Their resilience and load bearing capacity are alterable by voluntary or involuntary contraction which causes their cross-section to thicken.

SUMMARY OF THE INVENTION

In order to overcome these problems, the present invention provides an improved orthopedic hand grip for ambulation aids such as canes, walkers, crutches, outrigger skis, etc., which includes an elongated body possessing an axially inner end provided with a recess configured for partially receiving an elongated cylindrical support member of the ambulation aid, and an axially outer end including an enlarged circular ridge for preventing axial displacement of a user's hand. A mounting post extends axially through the body, transversely securing the hand grip to the support member. An obliquely forwardly and downwardly inclined platform on an upper side of the body adjacent the inner end applies a major portion of the user's weight to the hypothenar muscles of the user's hand. A depression formed axially outwardly of the platform provides a downwardly and axially outwardly curving concave load bearing surface for engagement with thenar muscles of a hand of a user such that the thumb of the user's hand is maintained in a palmar abducted orientation. A palmar arch supporting surface formed on a front portion of the body contiguously with the platform and depression possesses a convex curvature in both circumferential and axial directions. A plurality of axially spaced discrete finger indentations formed in a lower front portion of the body are disposed at an oblique angle with respect to a longitudinal axis of the support member. The platform, depression, palmar arch supporting surface and finger indentations prevent rotation of the hand of a user about a longitudinal axis of the body and maintain the wrist and arm of the user in axial alignment with the support member, and also prevent axial slippage of the hand along the hand grip to maintain the thumb and thenar muscles in proper position on the concave load bearing surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 2:
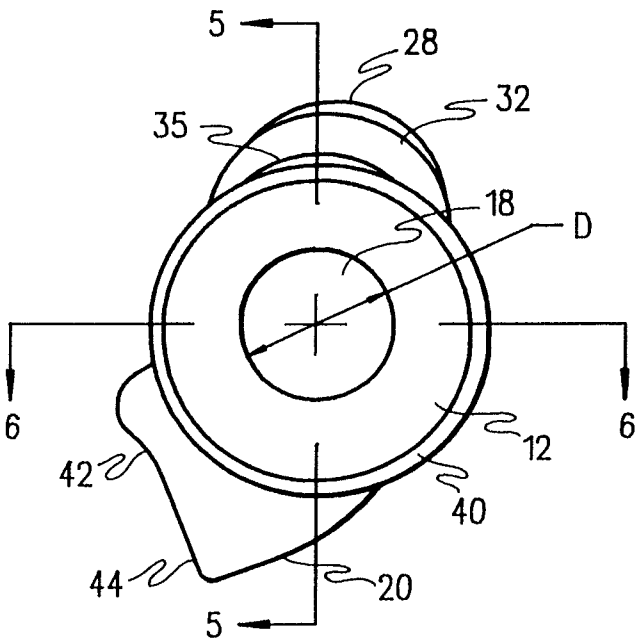
FIG. 2 is a top plan view illustrating the hand grip according to the present invention.

Referring now to the drawings, wherein like reference numerals designate corresponding structure throughout the views, an improved orthopedic hand grip 10 for ambulation aids, tools and other implements according to a preferred embodiment of the invention will now be described. It should be noted that the non-illustrated left hand grip is a mirror image of the right hand grip shown in the drawings. Accordingly, the construction of the left hand grip will be readily apparent to those of ordinary skill in the art with reference to the instant specification and drawings. Further, while the hand grip 10 is illustrated and described herein with respect to use in conjunction with a forearm crutch, it should be noted that the hand grip 10 is also usable in conjunction with canes, walkers, outrigger skis and other ambulation aids within the scope of the present invention. Additionally, the hand grip 10 may be advantageously employed as a handle for tools and other implements such as power tools, either electric or pneumatic, such as drills, impact drivers, chisels, saws, nail guns, staplers, battery powered instruments, manual hand tools, hammers, hatchets, shovels, etc. The hand grip 10 may also be employed in conjunction with various sporting equipment, such as outrigger skis, ski poles, kayak paddles, etc.

Figure 20:
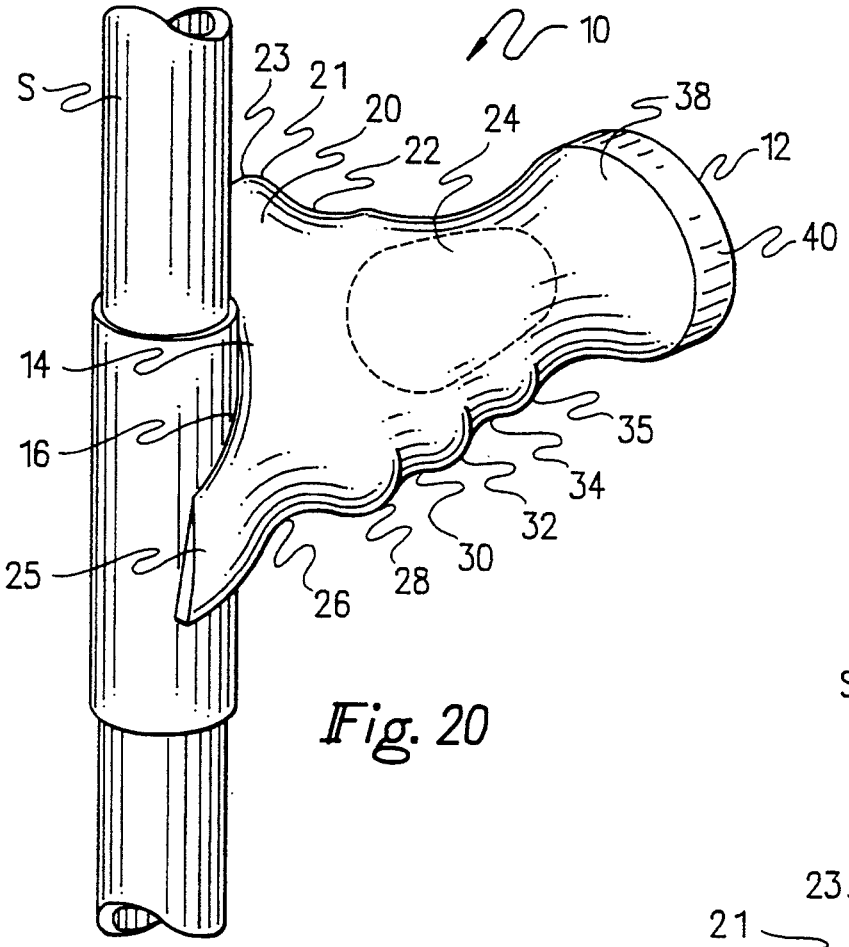
FIG. 20 is a front perspective view illustrating the hand grip according to the present invention.

In the context of this specification, the relative directional terms upper, upwardly, lower, downwardly, outer, outwardly, inner, forwardly, front, back and rearwardly are defined in relation to the usual substantially upright position of a crutch in an operative orientation as employed by a crutch user. Thus, "upper" and "upwardly" mean vertically upper, toward a crutch user's head; "lower" and "downwardly" mean vertically lower, toward a crutch user's feet; "outer" and "outwardly" mean laterally outer, away from a crutch user's body; "inner" means laterally inner, toward a crutch user's body; and "forwardly" and "front" mean toward the front side of a crutch user's body. FIG. 20 illustrates the front portion of the grip.

The hand grip 10 is preferably integrally molded or cast from a plastic material. Suitable thermo plastic elastomeric materials include melt processible rubber, particularly a halogenated ethylene interpolymer alloy, available under the trademark ALCRYN from DU PONT COMPANY, Polymer Products, of Wilmington, Delaware, and neoprene rubber, available under the trademark SANTOPRENE from MONSANTO CORPORATION. The hand grip 10 may also be formed as a composite from two or more different materials to optimize shock absorption capability, geometric stability, hardness and compression set characteristics. A preferred composite construction employs pads made of a visco elastic polymer material, available under the trademark SORBATHANE II from IEM MEDICAL TECHNOLOGIES, INC. of Ravenna, Ohio, as described in U.S. Pat. No. 4,346,205, the entire disclosure of which is incorporated herein by reference, and a base formed from a melt processible rubber. In the selection of materials, geometric stability characteristics have the highest priority, in order to maintain the shape of the grip while supporting the weight of a user. Shock absorption characteristics are a secondary consideration since the shock rates at the hand grip of a crutch are typically lower than those experienced in the shoes of a walking individual, which are less than 5 Gs. Additionally, most crutches employ rubber tips which function to absorb shock.

Figure 1:
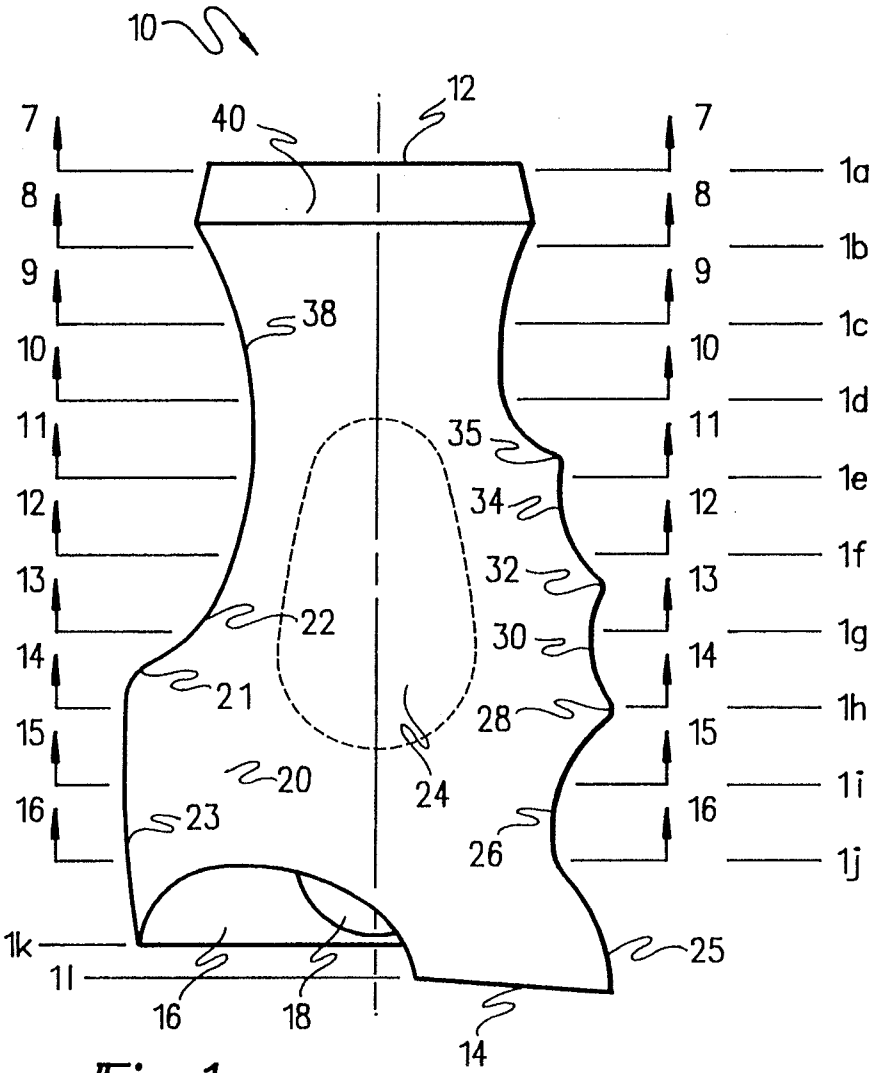
FIG. 1 is a side elevational view of the hand grip according to the present invention.
Figure 4:
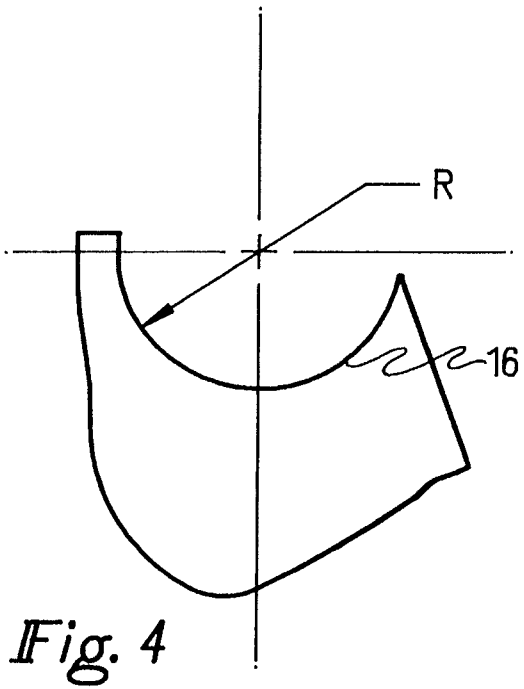
FIG. 4 is a detail view along line 4—4 of FIG. 3 illustrating the mounting channel portion of the hand grip according to the present invention.
Figure 3:
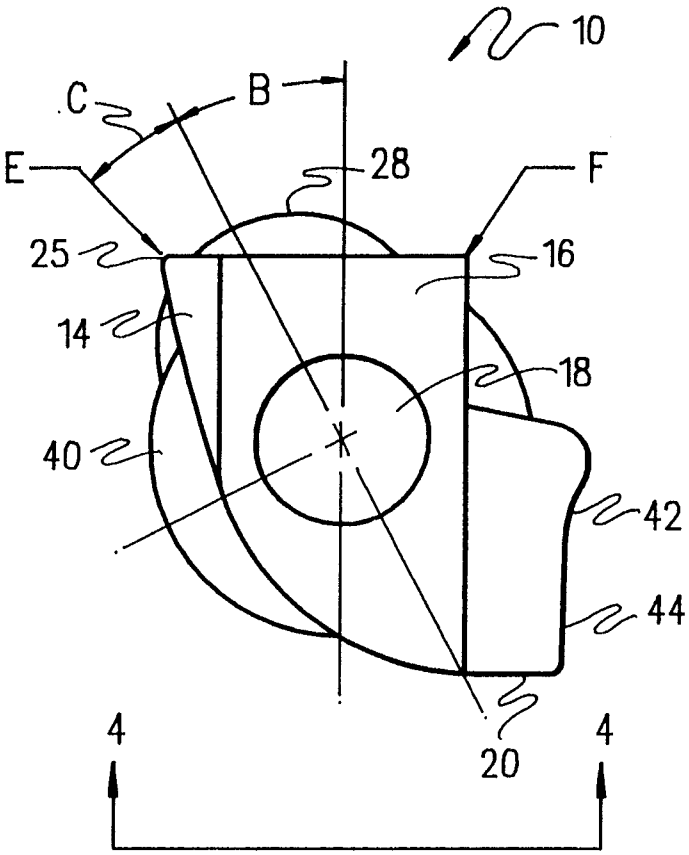
FIG. 3 is a bottom plan view illustrating the hand grip according to the present invention.
Figure 18:
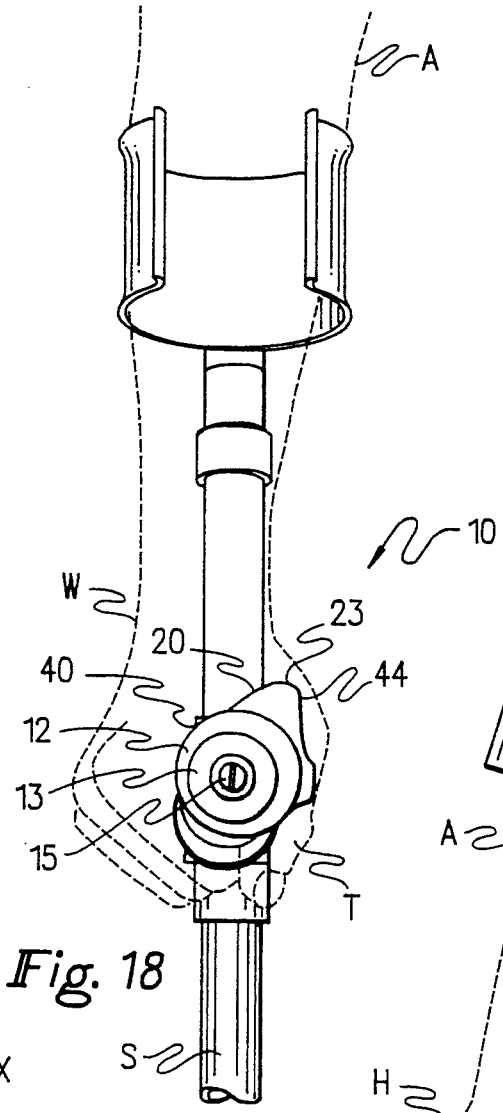
FIG. 18 is a side elevational view illustrating the axial alignment of the wrist and arm of a user of a crutch employing a hand grip according to the present invention.
Figure 21:
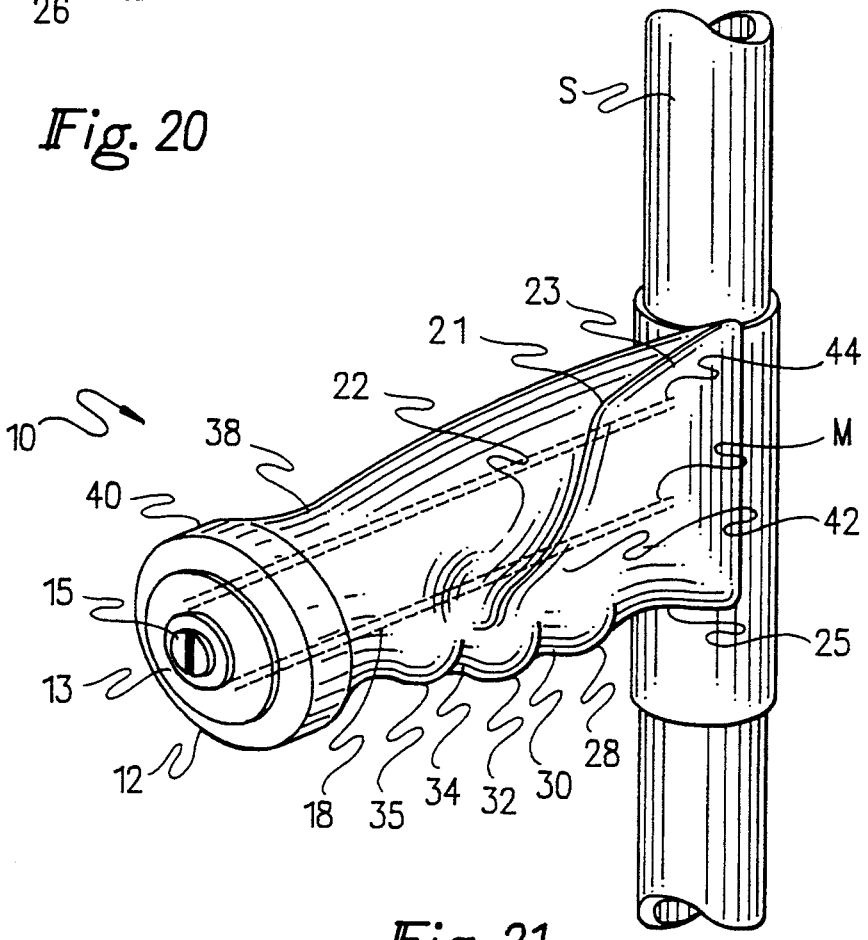
FIG. 21 is rear perspective view illustrating the hand grip according to the present invention.

As can be best appreciated from FIGS. 1, 20 and 21, the hand grip 10 is preferably formed as an elongated integral body possessing an axially outer, substantially circular first end face 12, and an axially inner second end face 14. A cylindrically curved recess 16 provided in the inner end face 14 of the hand grip 10 forms a mounting channel configured to conformingly receive a cylindrical side wall portion of an elongated crutch support shaft S. The support shaft S of a conventional crutch, and other ambulation aids, extends from an upper proximal end and terminates at a lower distal end in a ground engaging member. In the case of crutches, walkers and canes, the ground engaging member usually takes the form of a rubber tip. In the case of outrigger skis, the ground engaging member is essentially a short ski. For use with a standard size crutch shaft S, the recess 16 preferably has a radius R of 0.625 inches, as shown in FIG. 4. As depicted in FIG. 3, the central longitudinal axis of the cylindrical recess 16 is oriented at an angle B of 27 degrees with respect to the vertically extending reference axis shown in FIG. 2. An elongated aperture 18 extending axially through the hand grip 10 receives a mounting post M extending transversely from the crutch support shaft S. The aperture 18 is preferably formed with a diameter D of 0.875 inches, as shown in FIG. 2, for conformance with the mounting posts of standard crutches. As shown in FIG. 18, the hand grip 10 is secured to the mounting post M by a washer 13 and a screw 15 extending axially into threaded engagement with the mounting post M. Adhesives may also be employed in conjunction with the screw 15 to enhance securement of the grip 10 to the crutch support shaft S. As a result, the hand grip 10 is fixedly secured substantially transversely to the cylindrical support shaft S of the crutch. Various alternative arrangements may be employed for securing the hand grip 10 of the present invention to ambulation aids, tools and implements. For example, suitable adhesives may be utilized, or the hand grip 10 may be integrally molded with the particular ambulation aid, tool or implement.

Figure 19:
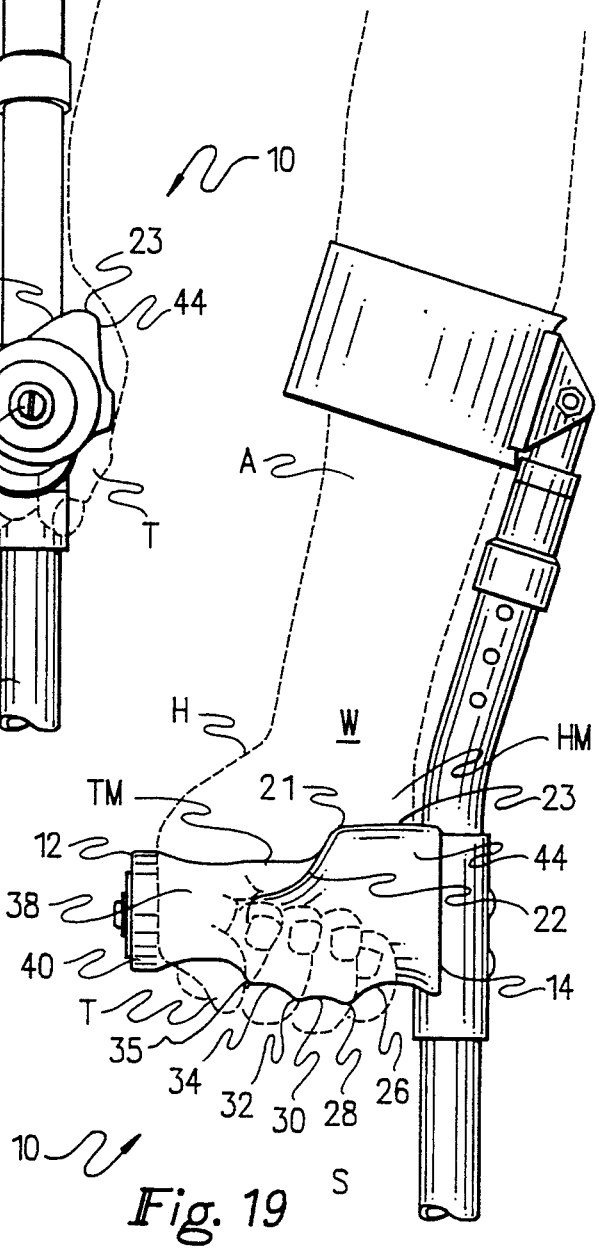
FIG. 19 is a rear elevational view illustrating the manner of engagement of a user's hand with a hand grip according to the present invention.

An obliquely forwardly and downwardly inclined platform 20 is substantially disposed on an upper side of the hand grip 10, adjacent the second end 14. The platform 20 extends axially outwardly toward the first end 12 of the hand grip 10, terminating at an axially outermost portion at a junction or ridge line 21 at a concave depression 22, and at a rear most portion at an apex line 23. The depression 22 curves downwardly and axially outwardly from ridge line 21 along an upper side of hand grip 10. A palmar arch supporting surface 24, indicated by an oval phantom line in FIGS. 1 and 20, formed contiguously with the platform 20 and depression 22 is convexly curved in both axial and circumferential directions with respect to hand grip 10. Ridges 28 and 32 separate a plurality of discrete finger indentations 26 (fifth metacarpal), 30 (fourth metacarpal), 34 (third metacarpal) spaced axially along the hand grip 10. The finger indentations 26, 30 and 34, as well as ridges 28, 32 and 35, are formed on a portion of the hand grip 10 possessing an increased radial dimension. A reduced diameter circumferentially extending trough 38, separated from finger indentation 34 by a ridge 35, is adapted for reception of the forefinger and thumb of a user, as shown in FIG. 19. Trough 38 terminates at an enlarged diameter circular ridge 40 formed adjacent the outer end face 12 of the hand grip 10 to prevent axially outward displacement of a user's hand. An obliquely inclined finger rest surface 42 extends rearwardly and upwardly from the finger indentations 26, 30, 34 along a back portion of the hand grip 10, merging with a substantially vertical back face 44 of platform 20, which extends downwardly from apex line 23.

Figure 17:
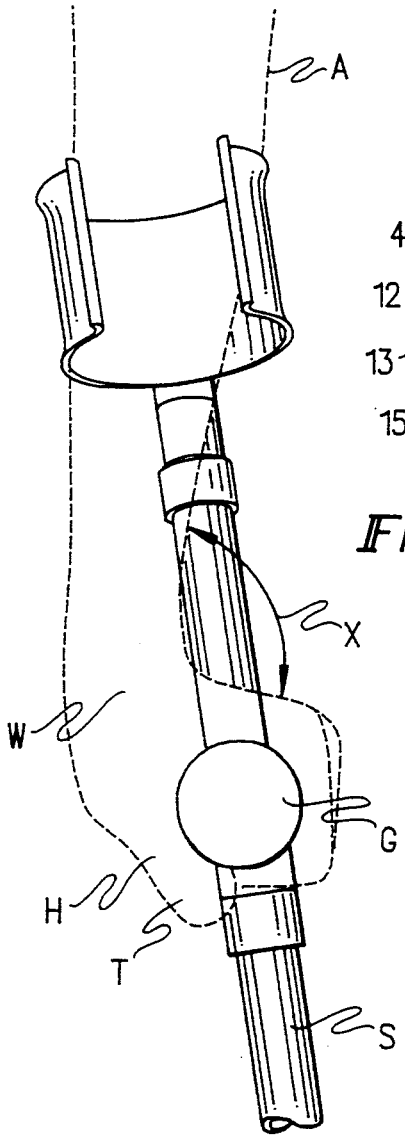
Fig. 17 (PRIOR ART)
FIG. 17 is a side elevational view illustrating typical dorsal flexation of the wrist and hand of a user of a crutch possessing a conventional cylindrical hand grip.

As shown in FIG. 17, the arm A and hand H of a user of a conventional crutch possessing a conventional cylindrical hand grip G are typically forced into an orientation in which the hand H is dorsally flexed at the wrist W relative to the arm A at an angle X which can be as small as ninety degrees, or even smaller, in extreme cases. In such a dorsally flexed configuration, forces transferred to the user's hand, wrist and arm include substantial undesirable shear and tension components which are not compatible with the anatomical structure of the hand, wrist and arm. This condition results from several deficiencies of the conventional cylindrical hand grip G. First, the hand grip G provides no structure to promote axial alignment of the arm A, wrist W and hand H with the longitudinal axis of the cylindrical crutch support shaft S. Second, the hand grip G has a relatively small surface area, and thus places a great deal of pressure on sensitive areas of the hand H, resulting in the potentially debilitating injuries described previously. Third, all surface portions of the hand grip G have a substantially equal radial extent or prominence from the central longitudinal axis of the hand grip G. Thus, the hand grip G has no topographical contour to provide proper anatomical distribution of force to areas of the hand H best suited to bear such loads. Additionally, the hand grip G has no provision to prevent or resist rotation of the hand H about the longitudinal axis of the hand grip G.

In contrast, the hand grip 10 of the present invention promotes axial alignment of the arm A, wrist W and hand H of a user with the support shaft S of a crutch, as illustrated in FIG. 18. The hand grip 10 effectively constrains alignment of the metacarpal bones with the ulna and radius bones to an included angle of one hundred and thirty degrees or greater in the longitudinal plane and zero degrees + or − five degrees in the lateral plane. This anatomically correct alignment results in the transmission of force from the hand to the arm substantially only in compression, without damage to the wrist and associated anatomical structures. With reference to FIGS. 19, 20 and 21, the hypothenar muscles HM of a user's hand H are supported on platform 20, which forms the uppermost surface of the hand grip 10, such that a major component of the weight of the user is born by the hypothenar muscles HM. Concave depression 22 engages the weaker thenat muscles TM of the hand H, forming a secondary load bearing surface. Platform 20, depression 22, palmar arch support 24 and radially projecting finger indentations 26, 30, 34, together form an effective barrier preventing rotation of the hand H about the longitudinal axis of the hand grip 10. Due to its compound convex curvature in both axial and circumferential directions, the palmar arch supporting surface 24 conforms to and supports the palmar arch region of the hand of a user, preventing injury to this sensitive area. An axially inwardly extending convex surface 25 forms a rest for the outside surface of a user's little finger, and also strengthens the securement of the hand grip 10 to the support shaft S by resisting rotation of the hand grip 10 about its longitudinal axis. As shown in FIG. 3, the radially outermost tip of surface 25, disposed at an angle C of 15 degrees with respect to the vertical reference axis shown in FIG. 2, has a radial extent E of 1.308 inches from the longitudinal central axis of bore 18. The edges of the end face 14, for example at corner F, are formed with a radius of 0.040 inches to avoid hazards from sharp edges and corners.

By virtue of the configuration of the platform 20, depression 22 and trough 38 of the hand grip 10 of the present invention, the thumb T of a user's hand H is maintained in a palmar abducted orientation, as shown in FIGS. 18 and 19, as contrasted with the more extended position of a user's thumb T illustrated in FIG. 17, resulting from the imposition of substantial forces on the web between the thumb and forefinger by the conventional cylindrical hand grip G. The palmar abducted orientation of the thumb T resulting from use of the hand grip 10 of the present invention not only prevents injury to tissues in the web region between the thumb and forefinger, but also diminishes the chance of trauma injury to the thumb occasioned by contact with extraneous objects. Further, the palmar abducted orientation of the thumb effects a natural bunching of the thenar muscles, and also, to a lesser extent, of the hypothenar muscles, resulting in a thickening of their cross-sections making them more capable of bearing sustained compressive loads.

The enlarged circular ridge 40 prevents axial displacement of the hand of a user outwardly along the hand grip 10. Such outward axial displacement is a common problem experienced by users of crutches possessing the conventional cylindrical hand grip G illustrated in FIG. 17, particularly when the support shaft S is oriented at an angle with respect to the vertical. The slippage of a hand of a user off a conventional crutch hand grip frequently results in falls and injuries.

The dimensions of a currently preferred embodiment of the hand grip 10 of the present invention are set forth in the following tables, with reference to FIGS. 1 and 5–16. It should be noted that the cross-sectional views depicted in FIGS. 7–16 have been rotated to conform with the positions of the vertical and horizontal references axes illustrated in FIG. 2. These dimensions are suitable for a hand grip intended for use by a male having large size hands, It is contemplated that hand grips in a range of various different sizes may be provided, for use by various diverse individuals.

Accordingly, while the dimensions given herein are illustrative of a single preferred size hand grip, a multitude of other size hand grips having larger or smaller dimensions may be formed within the scope of the present invention.

TABLE OF FIG. 1 DIMENSIONS

Dimensions 1*a* through 11 are the axial distances, in inches, from the end face 12 of the hand grip 10 to the associated transverse cross-sectional plane.

| Dimension Reference Character | Dimension In Inches | Associated Cross-Sectional Plane |
|---|---|---|
| 1a | 0.00 | 7—7 |
| 1b | 0.50 | 8—8 |
| 1c | 1.00 | 9—9 |
| 1d | 1.50 | 10—10 |
| 1e | 2.00 | 11—11 |
| 1f | 2.50 | 12—12 |
| 1g | 3.00 | 13—13 |

-continued

| Dimension Reference Character | Dimension In Inches | Associated Cross-Sectional Plane |
|---|---|---|
| 1h | 3.50 | 14—14 |
| 1i | 4.00 | 15—15 |
| 1j | 4.50 | 16—16 |
| 1k | 5.00 | |
| 1l | 5.25 | |

TABLE OF FIG. 5 DIMENSIONS

Figure 5:
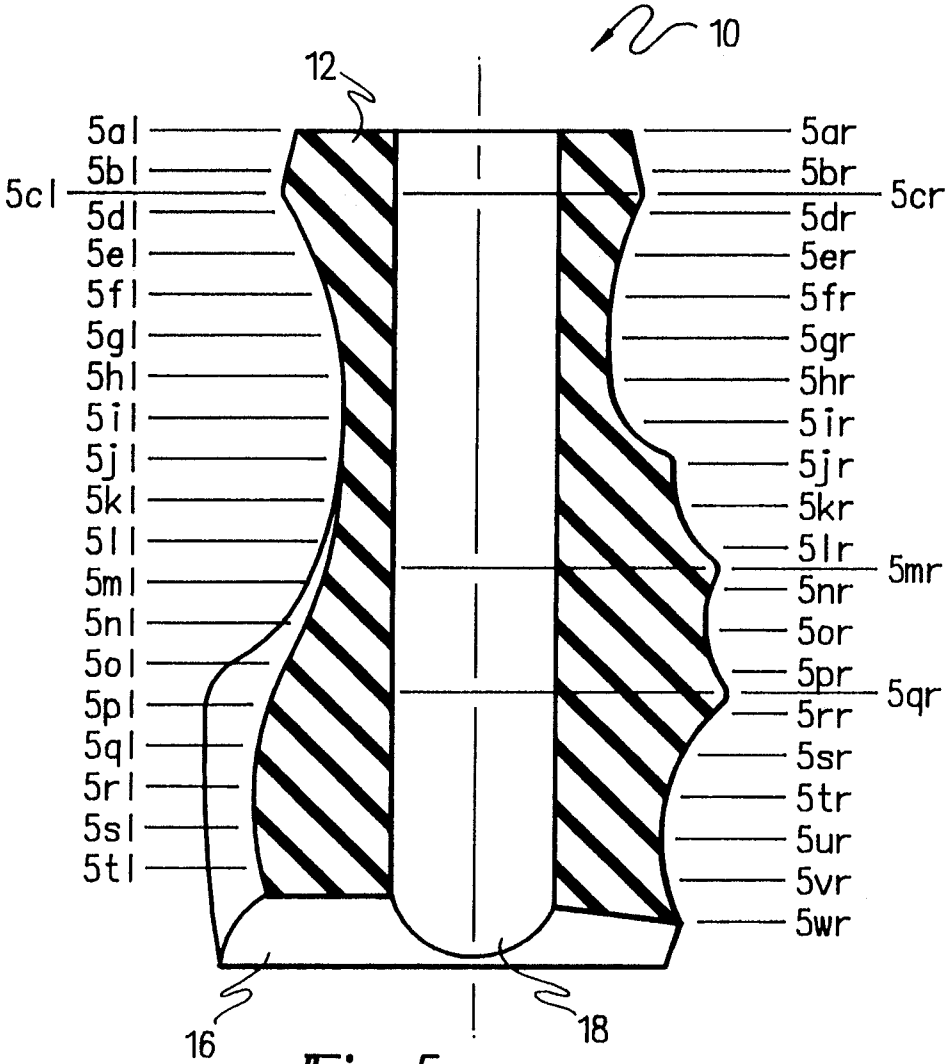
FIG. 5 is a longitudinal cross-section view taken along line 5—5 of FIG. 2 illustrating the hand grip according to the present invention.
Figure 8:
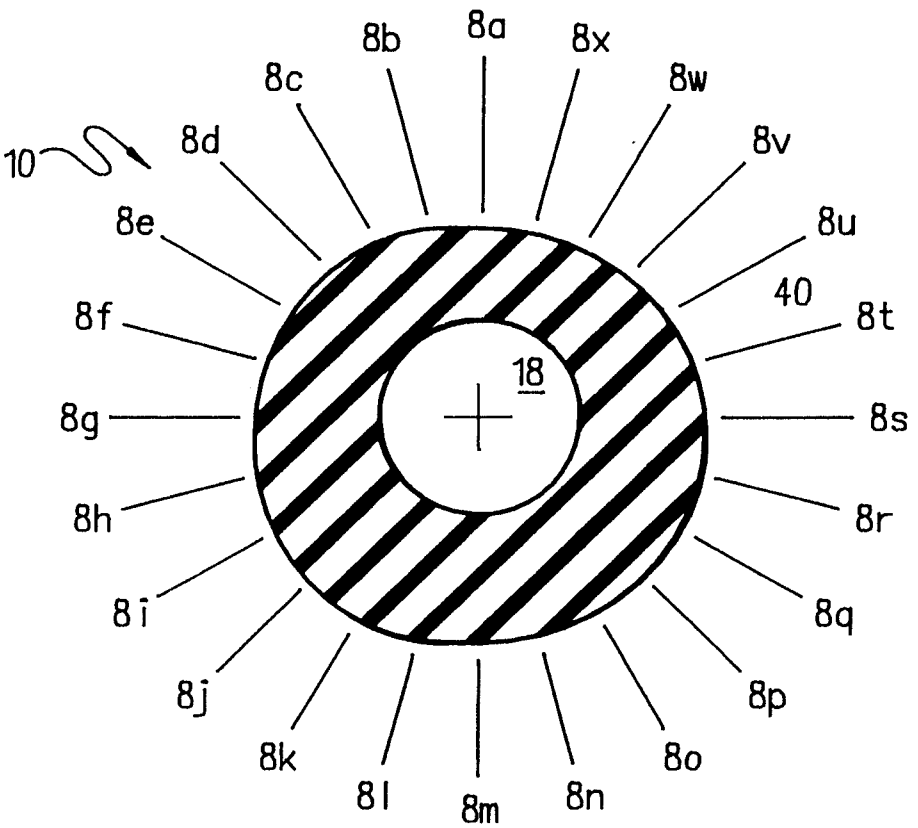
FIG. 8 is a transverse cross-sectional view taken along line 8—8 of FIG. 1 illustrating the hand grip according to the present invention.
Figure 7:
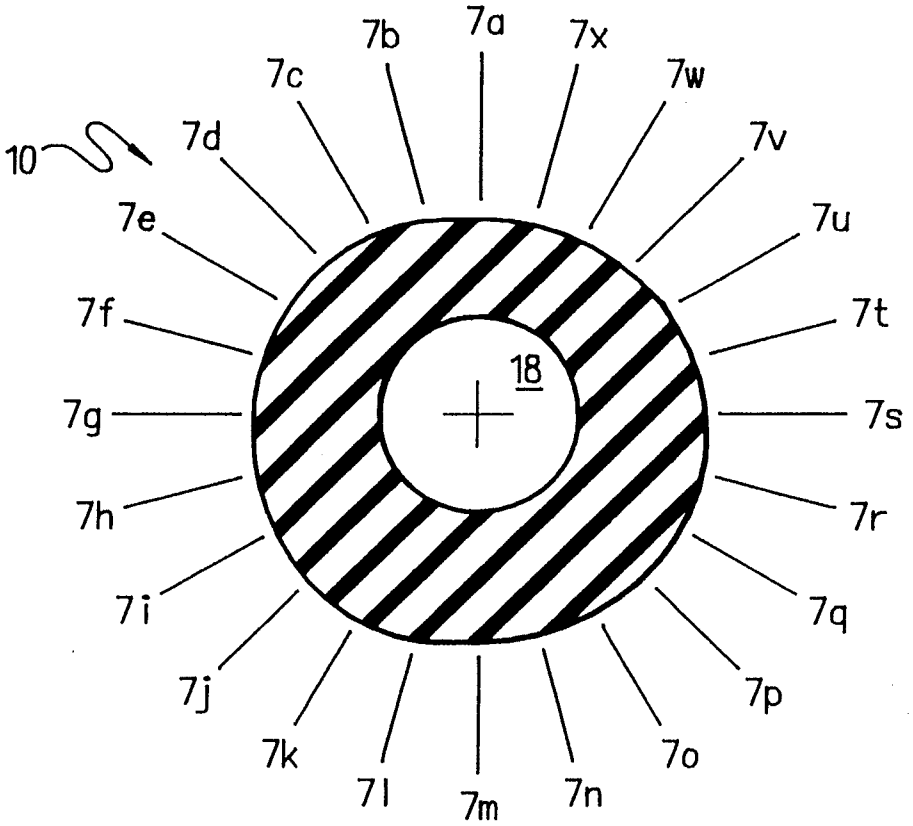
FIG. 7 is a transverse cross-sectional view taken along line 7—7 of FIG. 1 illustrating the hand grip according to the present invention.
Figure 10:
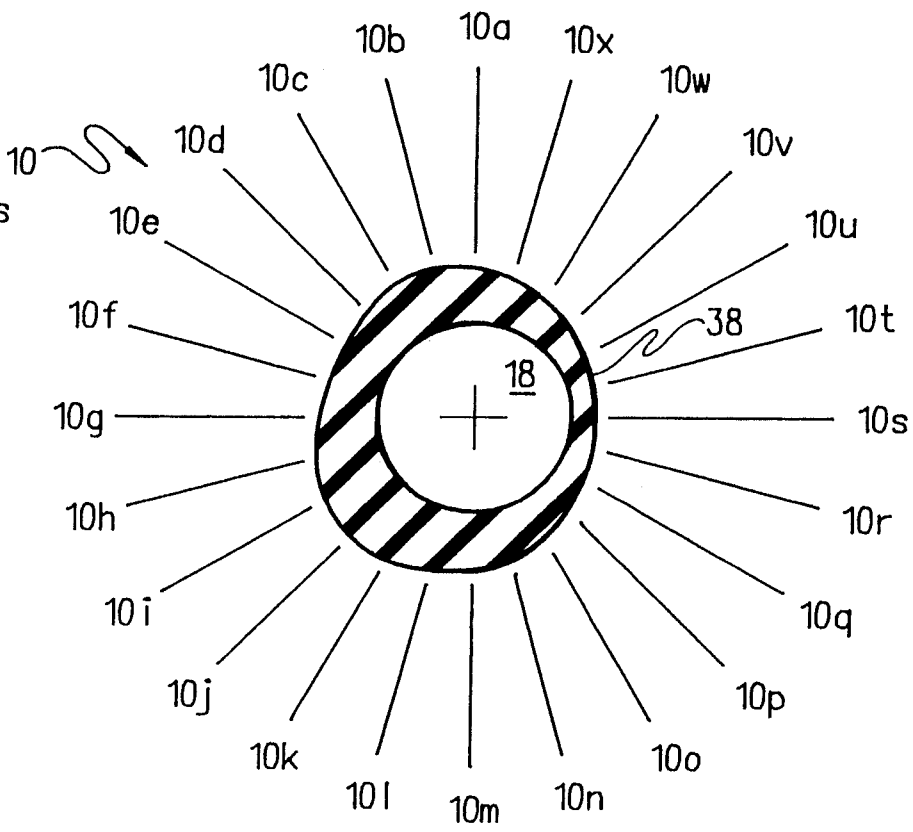
FIG. 10 is a transverse cross-sectional view taken along line 10—10 of FIG. 1 illustrating the hand grip according to the present invention.
Figure 9:
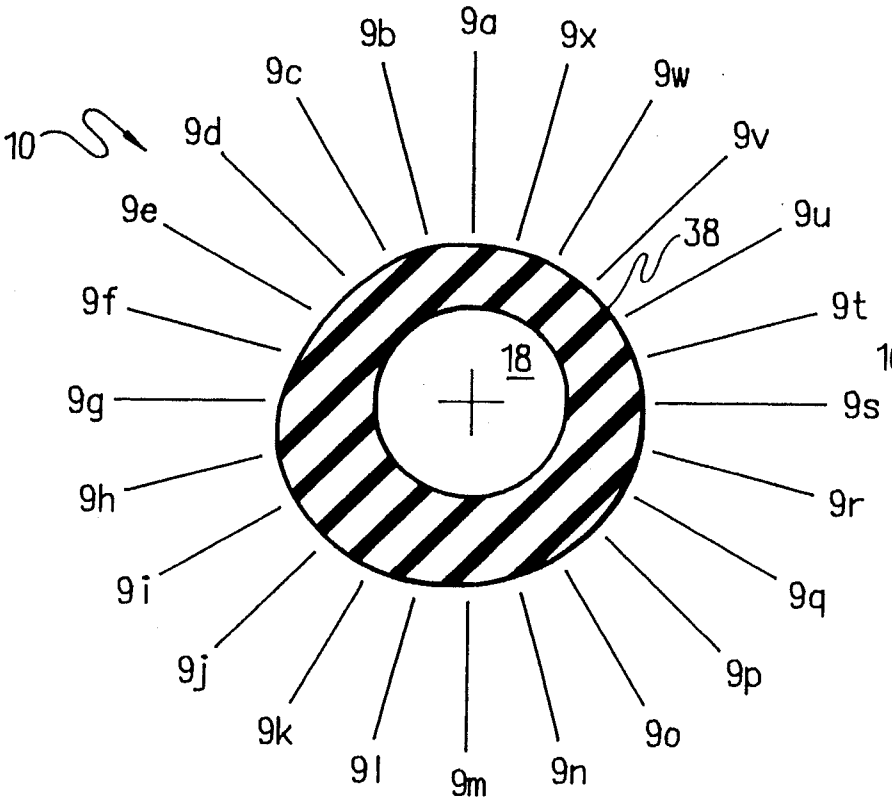
FIG. 9 is a transverse cross-sectional view taken along line 9—9 of FIG. 1 illustrating the hand grip according to the present invention.
Figure 12:
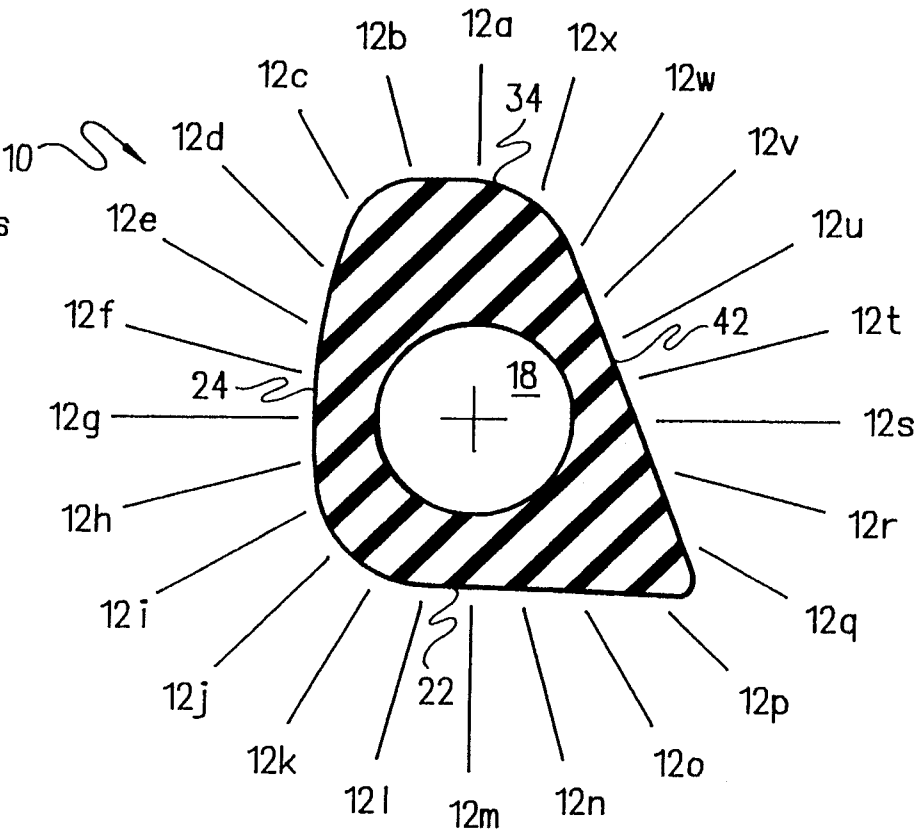
FIG. 12 is a transverse cross-sectional view taken along line 12—12 of FIG. 1 illustrating the hand grip according to the present invention.
Figure 11:
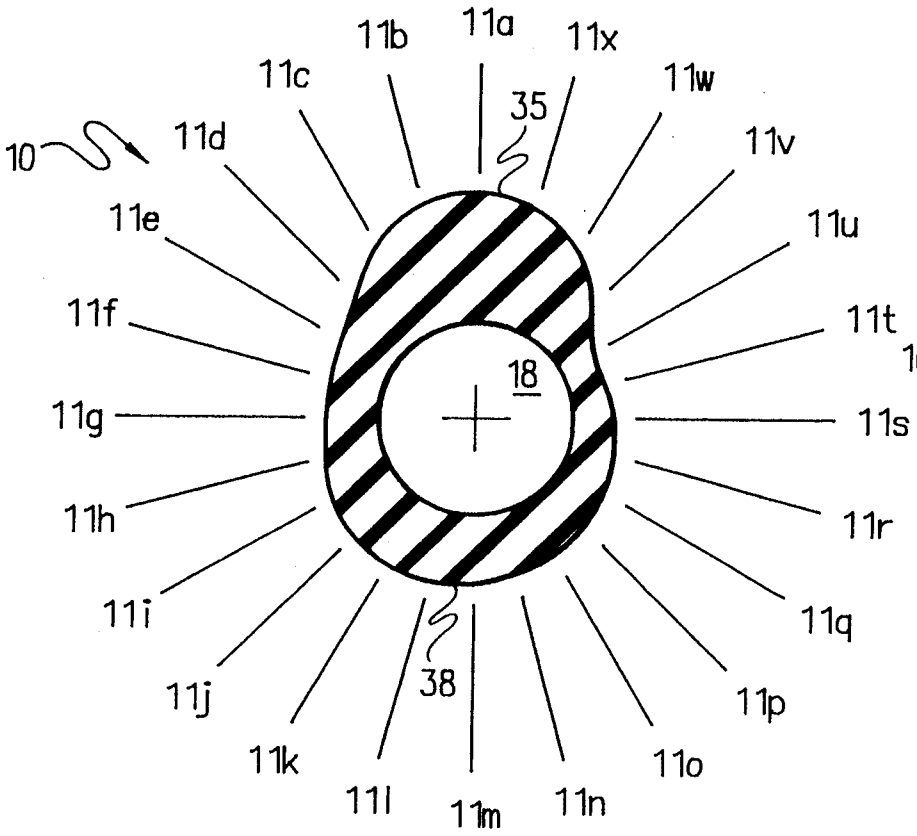
FIG. 11 is a transverse cross-sectional view taken along line 11—11 of FIG. 1 illustrating the hand grip according to the present invention.
Figure 14:
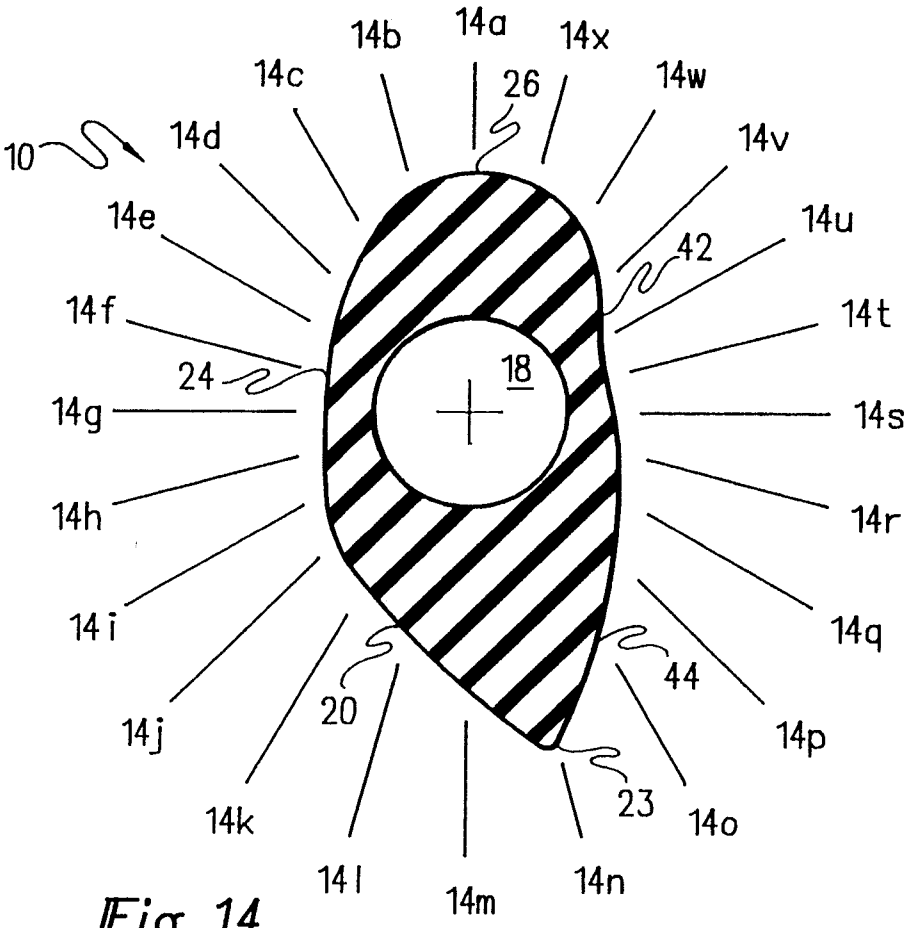
FIG. 14 is a transverse cross-sectional view taken along line 14—14 of FIG. 1 illustrating the hand grip according to the present invention.
Figure 13:
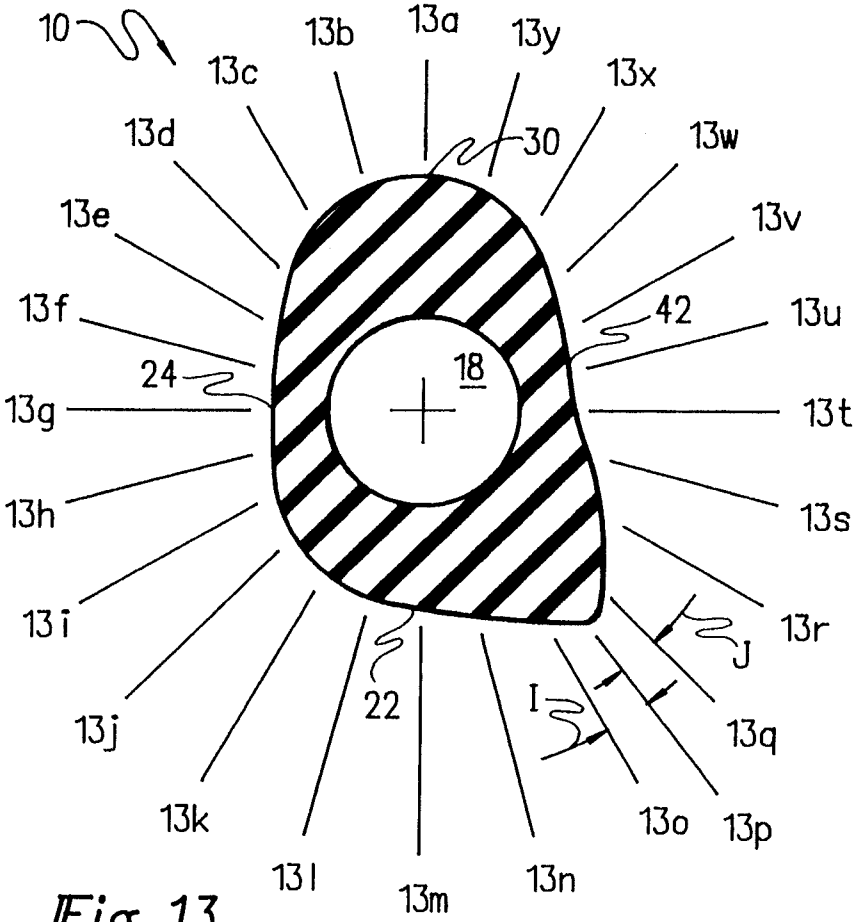
FIG. 13 is a transverse cross-sectional view taken along line 13—13 of FIG. 1 illustrating the hand grip according to the present invention.
Figure 16:
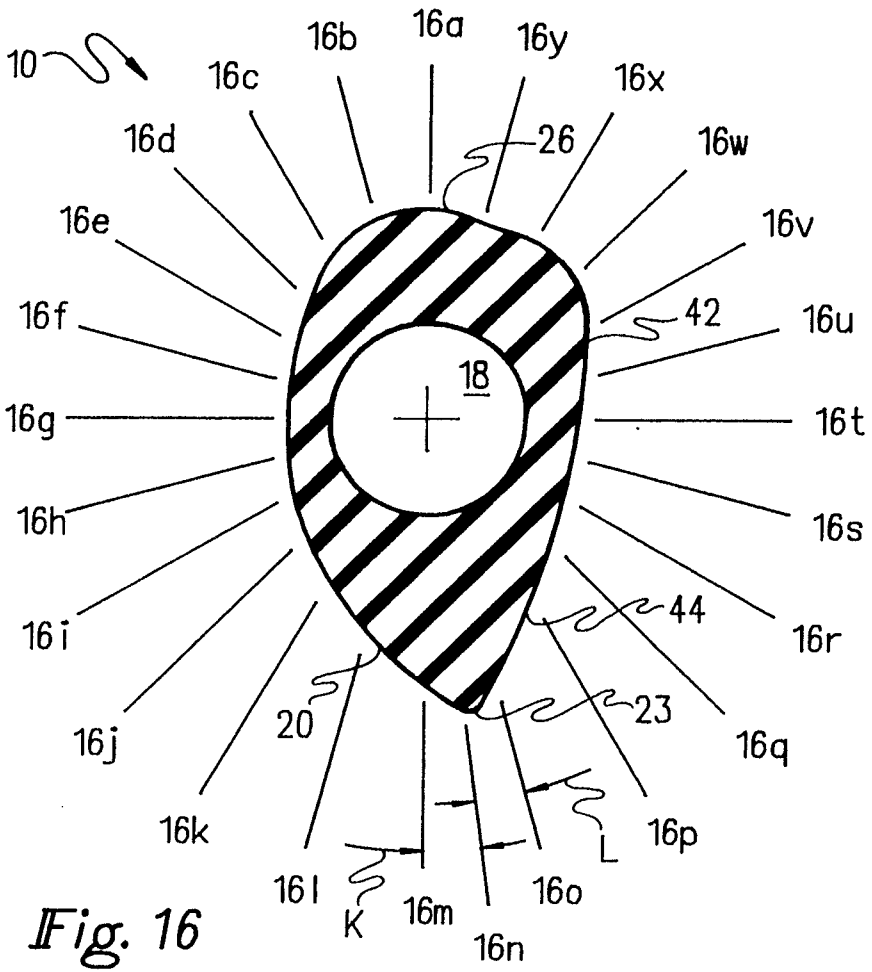
FIG. 16 is a transverse cross-sectional view taken along line 16—16 of FIG. 1 illustrating the hand grip according to the present invention.
Figure 15:
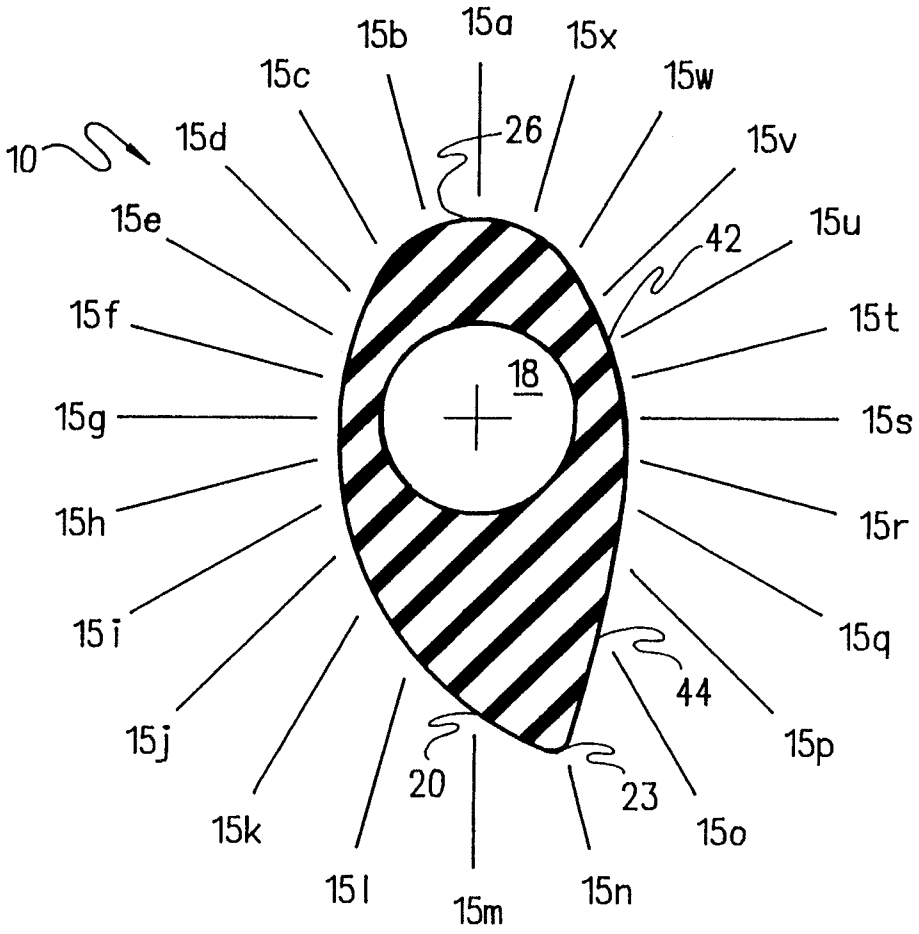
FIG. 15 is a transverse cross-sectional view taken along line 15—15 of FIG. 1 illustrating the hand grip according to the present invention.

Dimensions 52*al*–5*tl* are the radial distances from the central longitudinal axes of bore 18 to the outer surface of the hand grip 10 at the circumferential position indicated at the left hand side of FIG. 5. Dimensions 5*a*-*r*–5*wr* are the radial distances from the central longitudinal axis of bore 18 to the outer surface of the hand grip 10 at the circumferential position indicated at the right hand side of FIG. 5. The axial distance of each dimension 5*al*–5*tl* and *rar*–5*wr* from the end face 12 of the grip is also given in the following table.

| Dimension Reference Character | Radial Dimension In Inches | Axial Distance From End Face 12 Of Grip In Inches |
|---|---|---|
| 5al | 1.000 | 0.000 |
| 5bl | 1.067 | 0.250 |
| 5cl | 1.100 | 0.375 |
| 5dl | 1.010 | 0.500 |
| 5el | 0.870 | 0.750 |
| 5fl | 0.821 | 1.000 |
| 5gl | 0.744 | 1.250 |
| 5hl | 0.696 | 1.500 |
| 5il | 0.672 | 1.750 |
| 5jl | 0.707 | 2.000 |
| 5kl | 0.740 | 2.250 |
| 5ll | 0.768 | 2.500 |
| 5ml | 0.812 | 2.750 |
| 5nl | 0.890 | 3.000 |
| 5ol | 1.050 | 3.250 |
| 5pl | 1.110 | 3.500 |
| 5ql | 1.135 | 3.750 |
| 5rl | 1.174 | 4.000 |
| 5sl | 1.178 | 4.250 |
| 5tl | 1.145 | 4.500 |
| 5ar | 0.852 | 0.000 |
| 5br | 0.919 | 0.250 |
| 5cr | 0.952 | 0.375 |
| 5dr | 0.860 | 0.500 |
| 5er | 0.780 | 0.750 |
| 5fr | 0.732 | 1.000 |
| 5gr | 0.688 | 1.250 |
| 5hr | 0.689 | 1.500 |
| 5ir | 0.777 | 1.750 |
| 5jr | 0.997 | 2.000 |
| 5kr | 0.971 | 2.250 |
| 5lr | 1.089 | 2.500 |
| 5mr | 1.208 | 2.630 |
| 5nr | 1.132 | 2.750 |
| 5or | 1.062 | 3.000 |
| 5pr | 1.180 | 3.250 |
| 5qr | 1.225 | 3.340 |
| 5rr | 1.083 | 3.500 |
| 5sr | 0.926 | 3.750 |
| 5tr | 0.859 | 4.000 |
| 5ur | 0.855 | 4.250 |
| 5vr | 0.922 | 4.500 |
| 5wr | 1.036 | 4.750 |

TABLE OF FIG. 6 DIMENSIONS

Figure 6:
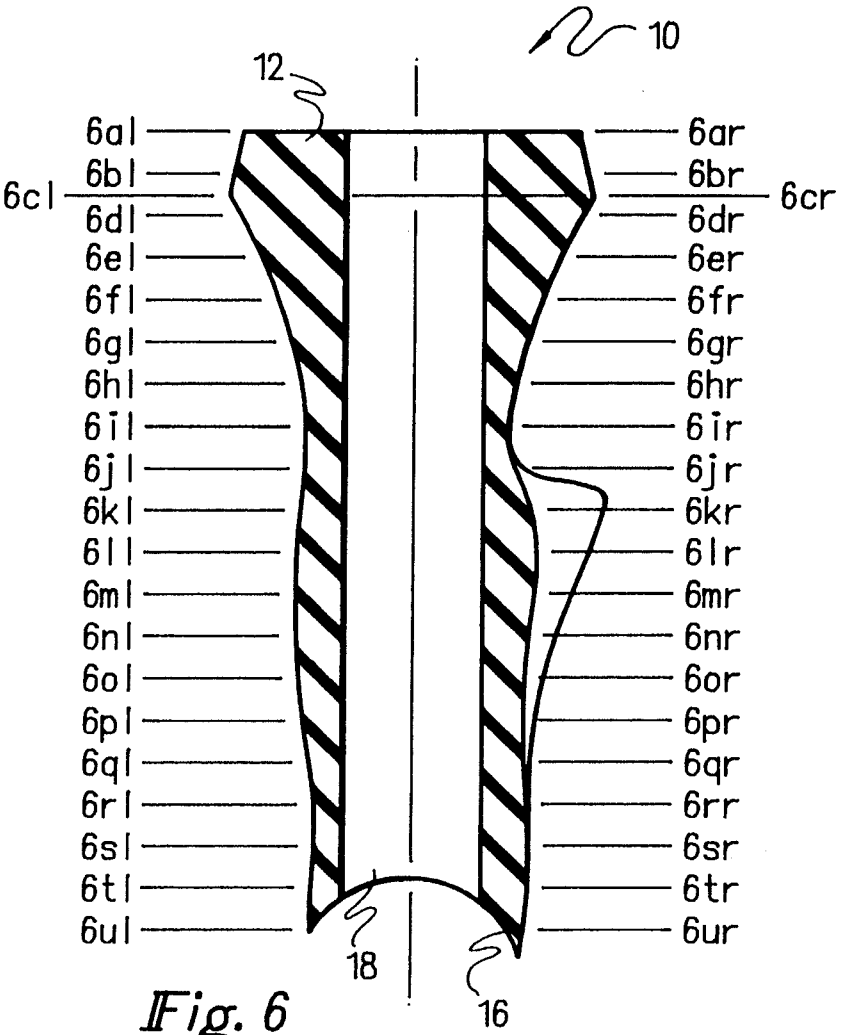
FIG. 6 is a longitudinal cross-sectional view taken along line 6—6 of FIG. 2 illustrating the hand grip according to the present invention.

Dimensions 6*al*–6*ul* are the radial distances from the central longitudinal axes of bore 18 to the outer surface of the hand grip 10 at the circumferential position indicated at the left hand side of FIG. 6. Dimensions 6*ar*–

*6ur* are the radial distances from the central longitudinal axis of bore 18 to the outer surface of the hand grip 10 at the circumferential position indicated at the right hand side of FIG. 6. The axial distance of each dimension *6al–6ul* and *6ar–6ur* from the end face 12 of the hand grip 10 is also given in the following table.

| Dimension Reference Character | Radial Dimension In Inches | Axial Distance From End Face 12 Of Grip In Inches |
|---|---|---|
| 6al | 0.987 | 0.000 |
| 6bl | 1.054 | 0.250 |
| 6cl | 1.087 | 0.375 |
| 6dl | 1.020 | 0.500 |
| 6el | 0.900 | 0.750 |
| 6fl | 0.809 | 1.000 |
| 6gl | 0.725 | 1.250 |
| 6hl | 0.652 | 1.500 |
| 6il | 0.650 | 1.750 |
| 6jl | 0.669 | 2.000 |
| 6kl | 0.679 | 2.250 |
| 6ll | 0.694 | 2.500 |
| 6ml | 0.700 | 2.750 |
| 6nl | 0 689 | 3.000 |
| 6ol | 0.674 | 3.250 |
| 6pl | 0.647 | 3.500 |
| 6ql | 0.629 | 3.750 |
| 6rl | 0.612 | 4.000 |
| 6sl | 0.580 | 4.250 |
| 6tl | 0.603 | 4.500 |
| 6ul | 0.625 | 4.750 |
| 6ar | 0.958 | 0.000 |
| 6br | 1.025 | 0.250 |
| 6cr | 1.058 | 0.375 |
| 6dr | 0.965 | 0.500 |
| 6er | 0.850 | 0.750 |
| 6fr | 0.758 | 1.000 |
| 6gr | 0.670 | 1.250 |
| 6hr | 0.565 | 1.500 |
| 6ir | 0.528 | 1.750 |
| 6jr | 0.590 | 2.000 |
| 6kr | 0.708 | 2.250 |
| 6lr | 0.711 | 2.500 |
| 6mr | 0.685 | 2.750 |
| 6nr | 0.660 | 3.000 |
| 6or | 0.650 | 3.250 |
| 6pr | 0.639 | 3.500 |
| 6qr | 0.656 | 3.750 |
| 6rr | 0.650 | 4.000 |
| 6sr | 0.673 | 4.250 |
| 6tr | 0.657 | 4.500 |
| 6ur | 0.639 | 4.750 |

TABLE OF FIG. 7 DIMENSIONS

Dimensions *7a* through *7x* are the radial distances, in inches, from the longitudinal central axis of bore 18 to the outer surface of the hand grip 10 at each angular position around the circumference of the hand grip 10. The angular spacing between each adjacent pair of the radial lines *7a* through *7x* is 15 degrees.

| Dimension Reference Character | Dimension In Inches |
|---|---|
| 7a | 0.852 |
| 7b | 0.868 |
| 7c | 0.897 |
| 7d | 0.915 |
| 7e | 0.968 |
| 7f | 0.977 |
| 7g | 0.997 |
| 7h | 1.009 |
| 7i | 1.020 |
| 7j | 1.021 |
| 7k | 1.014 |
| 7l | 0.997 |
| 7m | 1.000 |

-continued

| Dimension Reference Character | Dimension In Inches |
|---|---|
| 7n | 0.999 |
| 7o | 1.009 |
| 7p | 1.015 |
| 7q | 1.006 |
| 7r | 0.989 |
| 7s | 0.958 |
| 7t | 0.928 |
| 7u | 0.905 |
| 7v | 0.888 |
| 7w | 0.860 |
| 7x | 0.850 |

TABLE OF FIG. 8 DIMENSIONS

Dimensions *8a* through *8x* are the radial distances, in inches, from the longitudinal central axis of bore 18 to the outer surface of the hand grip 10 at each angular position around the circumference of the hand grip 10. The angular spacing between each adjacent pair of the radial lines *8a* through *8x* is 15 degrees.

| Dimension Reference Character | Dimension In Inches |
|---|---|
| 8a | 0.860 |
| 8b | 0.860 |
| 8c | 0.867 |
| 8d | 0.887 |
| 8e | 0.910 |
| 8f | 0.953 |
| 8g | 1.020 |
| 8h | 1.024 |
| 8i | 1.050 |
| 8j | 1.047 |
| 8k | 1.031 |
| 8l | 1.020 |
| 8m | 1.010 |
| 8n | 0.973 |
| 8o | 0.955 |
| 8p | 0.948 |
| 8q | 0.952 |
| 8r | 0.960 |
| 8s | 0.965 |
| 8t | 0.950 |
| 8u | 0.925 |
| 8v | 0.900 |
| 8w | 0.880 |
| 8x | 0.868 |

TABLE OF FIG. 9 DIMENSIONS

Dimensions *9a* through *9x* are the radial distances, in inches, from the longitudinal central axis of bore 18 to the outer surface of the hand grip 10 at each angular position around the circumference of the hand grip 10. The angular spacing between each adjacent pair of the radial lines *9a* through *9x* is 15 degrees.

| Dimension Reference Character | Dimension In Inches |
|---|---|
| 9a | 0.732 |
| 9b | 0.736 |
| 9c | 0.727 |
| 9d | 0.727 |
| 9e | 0.765 |
| 9f | 0.795 |
| 9g | 0.879 |
| 9h | 0.900 |
| 9i | 0.891 |
| 9j | 0.898 |
| 9k | 0.855 |
| 9l | 0.832 |

-continued

| Dimension Reference Character | Dimension In Inches |
|---|---|
| 9m | 0.821 |
| 9n | 0.802 |
| 9o | 0.780 |
| 9p | 0.774 |
| 9q | 0.772 |
| 9r | 0.767 |
| 9s | 0.758 |
| 9t | 0.739 |
| 9u | 0.735 |
| 9v | 0.726 |
| 9w | 0.717 |
| 9x | 0.713 |

TABLE OF FIG. 10 DIMENSIONS

Dimensions 10*a* through 10*x* are the radial distances, in inches, from the longitudinal central axis of bore 18 to the outer surface of the hand grip 10 at each angular position around the circumference of the hand grip 10. The angular spacing between each adjacent pair of the radial lines 10*a* through 10*x* is 15 degrees.

| Dimension Reference Character | Dimension In Inches |
|---|---|
| 10a | 0.689 |
| 10b | 0.703 |
| 10c | 0.683 |
| 10d | 0.654 |
| 10e | 0.628 |
| 10f | 0.625 |
| 10g | 0.652 |
| 10h | 0.706 |
| 10i | 0.752 |
| 10j | 0.768 |
| 10k | 0.759 |
| 10l | 0.727 |
| 10m | 0.696 |
| 10n | 0.665 |
| 10o | 0.628 |
| 10p | 0.592 |
| 10q | 0.567 |
| 10r | 0.562 |
| 10s | 0.565 |
| 10t | 0.571 |
| 10u | 0.577 |
| 10v | 0.597 |
| 10w | 0.622 |
| 10x | 0.652 |

TABLE OF FIG. 11 DIMENSIONS

Dimensions 11*a* through 11*x* are the radial distances, in inches, from the longitudinal central axis of bore 18 to the outer surface of the hand grip 10 at each angular position around the circumference of the hand grip 10. The angular spacing between each adjacent pair of the radial lines 11*a* through 11*x* is 15 degrees.

| Dimension Reference Character | Dimension In Inches |
|---|---|
| 11a | 0.997 |
| 11b | 0.978 |
| 11c | 0.882 |
| 11d | 0.745 |
| 11e | 0.678 |
| 11f | 0.655 |
| 11g | 0.669 |
| 11h | 0.705 |
| 11i | 0.756 |
| 11j | 0.775 |
| 11k | 0.762 |

-continued

| Dimension Reference Character | Dimension In Inches |
|---|---|
| 11l | 0.732 |
| 11m | 0.707 |
| 11n | 0.690 |
| 11o | 0.672 |
| 11p | 0.663 |
| 11q | 0.640 |
| 11r | 0.615 |
| 11s | 0.590 |
| 11t | 0.563 |
| 11u | 0.577 |
| 11v | 0.710 |
| 11w | 0.869 |
| 11x | 0.966 |

TABLE OF FIG. 12 DIMENSIONS

Dimensions 12*a* through 12*x* are the radial distances, in inches, from the longitudinal central axis of bore 18 to the outer surface of the hand grip 10 at each angular position around the circumference of the hand grip 10. The angular spacing between each adjacent pair of the radial liens 12*a* through 12*x* is 15 degrees.

| Dimension Reference Character | Dimension In Inches |
|---|---|
| 12a | 1.089 |
| 12b | 1.103 |
| 12c | 0.985 |
| 12d | 0.847 |
| 12e | 0.752 |
| 12f | 0.704 |
| 12g | 0.694 |
| 12h | 0.721 |
| 12i | 0.769 |
| 12j | 0.801 |
| 12k | 0.802 |
| 12l | 0.777 |
| 12m | 0.768 |
| 12n | 0.800 |
| 12o | 0.931 |
| 12p | 1.162 |
| 12q | 1.047 |
| 12r | 0.846 |
| 12s | 0.711 |
| 12t | 0.687 |
| 12u | 0.710 |
| 12v | 0.782 |
| 12w | 0.889 |
| 12x | 1.022 |

TABLE OF FIG. 13 DIMENSIONS

Dimensions 13*a* through 13*y* are the radial distances from the longitudinal central axis of bore 18 to the outer surface of the grip at each angular position around the circumference of the grip. The angular spacing between each adjacent pair of the radial lines 13*a* through 13*y* is 15 degrees, except that the angle I between lines 13*o* and 13*p* is 8 degrees and the angle J between lines 13*p* and 13*q* is 7 degrees.

| Dimension Reference Character | Dimension In Inches |
|---|---|
| 13a | 1.062 |
| 13b | 1.064 |
| 13c | 0.971 |
| 13d | 0.862 |
| 13e | 0.756 |
| 13f | 0.702 |
| 13g | 0.689 |

-continued

| Dimension Reference Character | Dimension In Inches |
|---|---|
| 13h | 0.709 |
| 13i | 0.764 |
| 13j | 0.815 |
| 13k | 0.841 |
| 13l | 0.841 |
| 13m | 0.890 |
| 13n | 0.971 |
| 13o | 1.128 |
| 13p | 1.200 |
| 13q | 1.119 |
| 13r | 0.891 |
| 13s | 0.751 |
| 13t | 0.660 |
| 13u | 0.653 |
| 13v | 0.721 |
| 13w | 0.805 |
| 13x | 0.928 |
| 13y | 1.027 |

TABLE OF FIG. 14 DIMENSIONS

Dimensions 14*a* through 14*x* are the radial distances, in inches, from the longitudinal central axis of bore 18 to the outer surface of the hand grip 10 at each angular position around the circumference of the hand grip 10. The angular spacing between each adjacent pair of the radial lines 14*a* through 14*x* is 15 degrees.

| Dimension Reference Character | Dimension In Inches |
|---|---|
| 14a | 1.083 |
| 14b | 1.065 |
| 14c | 0.916 |
| 14d | 0.787 |
| 14e | 0.701 |
| 14f | 0.658 |
| 14g | 0.647 |
| 14h | 0.673 |
| 14i | 0.737 |
| 14j | 0.807 |
| 14k | 0.896 |
| 14l | 1.027 |
| 14m | 1.210 |
| 14n | 1.532 |
| 14o | 1.202 |
| 14p | 0.978 |
| 14q | 0.808 |
| 14r | 0.711 |
| 14s | 0.639 |
| 14t | 0.624 |
| 14u | 0.665 |
| 14v | 0.784 |
| 14w | 0.962 |
| 14x | 1.052 |

TABLE OF FIG. 15 DIMENSIONS

Dimensions 15*a* through 15*x* are the radial distances, in inches, from the longitudinal central axis of bore 18 to the outer surface of the hand grip 10 at each angular position around the circumference of the hand grip 10. The angular spacing between each adjacent pair of the radial lines 15*a* through 15*x* is 15 degrees.

| Dimension Reference Character | Dimension In Inches |
|---|---|
| 15a | 0.859 |
| 15b | 0.852 |
| 15c | 0.772 |
| 15d | 0.692 |
| 15e | 0.632 |

-continued

| Dimension Reference Character | Dimension In Inches |
|---|---|
| 15f | 0.607 |
| 15g | 0.612 |
| 15h | 0.651 |
| 15i | 0.722 |
| 15j | 0.793 |
| 15k | 0.901 |
| 15l | 1.092 |
| 15m | 1.274 |
| 15n | 1.481 |
| 15o | 1.043 |
| 15p | 0.857 |
| 15q | 0.745 |
| 15r | 0.683 |
| 15s | 0.650 |
| 15t | 0.651 |
| 15u | 0.669 |
| 15v | 0.700 |
| 15w | 0.749 |
| 15x | 0.821 |

TABLE OF FIG. 16 DIMENSIONS

Dimensions 16*a* through 16*y* are the radial distances from the longitudinal central axis of bore 18 to the outer surface of the hand grip 10 at each angular position around the circumference of the hand grip 10. The angular spacing between each adjacent pair of the radial lines 16*a* through 16*y* is 15 degrees, except that the angle K between lines 16*m* and 16*n* is 7 degrees and the angle L between lines 16*n* and 16*o* is 8 degrees.

| Dimension Reference Character | Dimension In Inches |
|---|---|
| 16a | 0.922 |
| 16b | 0.907 |
| 16c | 0.806 |
| 16d | 0.710 |
| 16e | 0.631 |
| 16f | 0.601 |
| 16g | 0.603 |
| 16h | 0.635 |
| 16i | 0.690 |
| 16j | 0.758 |
| 16k | 0.850 |
| 16l | 1.022 |
| 16m | 1.230 |
| 16n | 1.330 |
| 16o | 1.145 |
| 16p | 0.890 |
| 16q | 0.732 |
| 16r | 0.666 |
| 16s | 0.642 |
| 16t | 0.657 |
| 16u | 0.719 |
| 16v | 0.825 |
| 16w | 0.930 |
| 16x | 0.926 |
| 16y | 0.919 |

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. In combination with an ambulation aid including an elongated support member possessing an upper proximal end and terminating at a lower distal end in a ground engaging member, a hand grip comprising:

an elongated body possessing a circumference, a longitudinal axis, an axially outer first end and an axially inner second end, an upper side, a front portion, and a lower front portion;

means securing said hand grip to said elongated support member intermediate said upper proximal and lower distal ends in a substantially transverse orientation to said support member;

said body possessing an obliquely forwardly and downwardly inclined non-concave platform disposed adjacent said second end and extending axially outwardly along said body toward said first end, said platform substantially disposed on said upper side of said body and forming an uppermost surface of said hand grip directed toward said upper proximal end of said elongated support member, said platform forming a load bearing surface dimensioned and disposed for engagement with hypothenar muscles of a hand of a user; and said platform terminating at an axially outer end in an depression extending from said platform axially outwardly toward said first end of said body, said depression forming a downwardly and axially outwardly curving concave load bearing surface substantially disposed on said upper side of said body radially inwardly from said platform and directed toward said upper proximal end of said elongated support member, said concave load bearing surface dimensioned and disposed for engagement with thenar muscles of a hand of a user such that a thumb of a user's hand is maintained in a palmar abducted orientation and a user's hand, wrist, and arm are maintained substantially in alignment with said elongated support member.

2. The combination of claim 1, further comprising a palmar arch supporting surface formed on said body, said palmar arch supporting surface formed substantially contiguously with said platform and depression and substantially disposed on said front portion of said boyd, said palmar arch supporting surface possessing a convex curvature in both circumferential and axial directions with respect to said body.

3. The combination of claim 2, further comprising a plurality of discrete finger indentations formed in said lower front portion of said body, said finger indentations spaced axially along said body and directed substantially downwardly at an acute angle with respect to a longitudinal axis of said elongated support member.

4. The combination of claim 3, wherein said platform, depression and finger indentations are dimensioned and disposed to provide means for substantially preventing a hand of a user grasping said hand grip from rotating around said longitudinal axis of said body and means for distributing a greater portion of a user's weight to hypothenar muscles of a user's hand than that distributed to thenar muscles.

5. The combination of claim 1, further comprising a plurality of discrete finger indentations formed in said lower front portion of said body, said finger indentations spaced axially along said body and directed substantially downwardly at an acute angle with respect to a longitudinal axis of said elongated support member.

6. The combination of claim 5, further comprising an obliquely inclined finger rest surface extending rearwardly and upwardly from said finger indentations along a back portion of said body.

7. The combination of claim 6, further comprising a reduced diameter circumferentially extending trough extending from an axially outward extent of said finger indentations and said depression, said trough dimensioned and disposed to at least partially receive a thumb of a user's hand.

8. The combination of claim 1, further comprising an enlarged diameter circular ridge formed adjacent said first end of said body for preventing axially outward displacement of a user'hand along said body.

9. In combination with an ambulation aid including an elongated support member possessing an upper proximal end and terminating at a lower distal end in a ground engaging member, a hand grip comprising:

an elongated body possessing, a circumference, a longitudinal axis, an axially outer first end and an axially inner second end, an upper side, a front portion, a back portion, and a lower front portion;

means for securing said hand grip to said elongated support member intermediate said upper proximal and lower distal ends in a substantially transverse orientation to said support member;

said body possessing an obliquely forwardly and downwardly inclined non-concave platform disposed adjacent said second end and extending axially outwardly along said body toward said first end, said platform substantially disposed on said upper side of said body and forming an uppermost surface of said hand grip directed toward said upper proximal end of said elongated support member, said platform forming a load bearing surface dimensioned and disposed for engagement with hypothenar muscles of a hand of a user;

said platform terminating at an axially outer end in a depression extending from said platform axially outwardly toward said first end of said body, said depression forming a downwardly and axially outwardly curving concave load bearing surface substantially disposed on said upper side of said body radially inwardly from said platform and directed toward said upper proximal end of said elongated support member, said concave load bearing surface dimensioned and disposed for engagement with thenar muscles of a hand of a user such that a thumb of a user's hand is maintained in a palmar abducted orientation and a user's hand, wrist, and arm are maintained in alignment with said elongated support member;

a palmar arch supporting surface formed on said body, said palmar arch supporting surface formed substantially contiguously with said platform and depression and substantially disposed on said front portion of said body, said palmar arch supporting surface possessing a convex curvature in both circumferential and axial directions with respect to said body;

a plurality of discrete finger indentations formed in said lower front portion of said body, said finger indentations spaced axially along said body and directed substantially downwardly at an acute angel with respect to a longitudinal axis of said elongated support member;

said platform, depression and finger indentations dimensioned and disposed to provide means for substantially preventing a hand of a user grasping said hand grip from rotating around said longitudinal axis of said body and means for distributing a greater portion of a user's weight to hypothenar muscles of a user's hand than that distributed to thenar muscles;

an obliquely inclined finger rest surface extending rearwardly and upwardly from said finger indentations along said back portion of said body;

a reduced diameter circumferentially extending trough extending from an axially outward extent of said finger indentations and said depression, said trough dimensioned to at least partially receive a thumb of a user's hand; and an enlarged diameter circular ridge formed adjacent said first end of said body for preventing axially outward displacement of a user's hand along said body.

10. In combination with an ambulation aid including an elongated support member possessing an upper proximal end and terminating at a lower distal end in a ground engaging member, a hand grip, comprising:

an elongated body possessing a circumference, a longitudinal axis, an upper side, a front portion, a back portion, a lower front portion, an axially outer first end and an axially inner second end provided with a recess configured for at least partially receiving a portion of said support member;

an elongated aperture extending axially through said body from said first end into communication with said recess;

a mounting post secured to said support member and received through said aperture for securing sand hand grip to said support member in a substantially transverse orientation;

said body possessing an obliquely forwardly and downwardly inclined non-concave platform disposed adjacent aid second end and extending axially outwardly along said body toward said first end, said platform substantially disposed on said upper side of said body and forming an uppermost surface of said hand grip directed toward said proximal end of said support member, said platform forming a load bearing surface dimensioned and disposed for engagement with hypothenar muscles of a hand of a user;

said platform terminating at an axially outer end in a depression extending from said platform axially outwardly toward said first end of said body, said depression forming a downwardly and axially outwardly curving concave load bearing surface substantially disposed on said upper side of said body radially inwardly from said platform and directed toward said proximal end of said support member, said concave load bearing surface dimensioned and disposed for engagement with thenar muscles of a hand of a user such that a thumb of a user's hand is maintained in a palmar abducted orientation and a user's hand, wrist, and arm are maintained substantially in alignment with said elongated support member;

a palmar arch supporting surface formed on said body, said palmar arch supporting surface formed substantially contiguously with said platform and depression and substantially disposed on said front portion of said body, said palmar arch supporting surface possessing a convex curvature in both circumferential and axial directions with respect to said body;

a plurality of discrete finger indentations formed in said lower front portion of said body, said finger indentations spaced axially along said body and directed substantially downwardly at an acute angle with respect to a longitudinal axis of said support member;

said platform, depression and finger indentations dimensioned and disposed to provide means for substantially preventing a hand of a user grasping said hand grip from rotating around said longitudinal axis of said body and means for distributing a greater portion of a user's weight to hypothenar muscles of a user's hand than that distributed to thenar muscles; an obliquely inclined finger rest surface extending rearwardly and upwardly from said finger indentations along said back portion of said body;

a reduced diameter circumferentially extending trough extending from an axially outward extent of said finger indentations and said depression, said trough dimensioned to at least partially receive a thumb of a user's hand; and an enlarged diameter circular ridge formed adjacent said first end of said body for preventing axially outward displacement of a user's hand along said body.

* * * * *